US005492077A

United States Patent [19]

Rose

[11] Patent Number: 5,492,077

[45] Date of Patent: Feb. 20, 1996

[54] INDICATING POP TOP BEVERAGE CONTAINER

[76] Inventor: Howard L. Rose, 2721 NE. 10th St., Pompano Beach, Fla. 33062

[21] Appl. No.: 408,939

[22] Filed: Mar. 23, 1995

[51] Int. Cl.[6] ..... G09F 9/40

[52] U.S. Cl. ..... 116/307; 116/201; 116/320; 40/307

[58] Field of Search ..... 40/307, 311; 116/306, 116/307, 308, 309, 310, 311, 312, 313, 314, 315, 316, 319, 320, 201; 215/230

[56] References Cited

U.S. PATENT DOCUMENTS

| | | | |
|---|---|---|---|
| 2,024,889 | 12/1935 | Simeone | 116/311 |
| 3,930,592 | 1/1976 | Dilanni | 116/205 X |
| 3,958,354 | 5/1976 | Hough | 40/307 |
| 3,974,916 | 8/1976 | Bartolucci | 116/307 X |
| 4,325,230 | 4/1982 | Driscoll et al. | 62/293 |
| 4,361,251 | 11/1982 | Langseder | 206/269 |
| 4,363,179 | 12/1982 | Ruemer, Jr. et al. | 40/307 |
| 4,729,472 | 3/1988 | Lubin | 206/315.9 |
| 5,301,802 | 4/1994 | Nemeroff | 206/217 |
| 5,386,795 | 2/1995 | Bartholomew | 116/308 |

FOREIGN PATENT DOCUMENTS

| | | | |
|---|---|---|---|
| 0065302 | 11/1982 | European Pat. Off. | 116/307 |

*Primary Examiner*—William A. Cuchlinski, Jr.
*Assistant Examiner*—Willie Morris Worth
*Attorney, Agent, or Firm*—Alvin S. Blum

[57] ABSTRACT

An easy open beverage container has a lever tab for breaking open a scored panel portion of the end wall by lifting up the distal lift end. The tab is held rotatably to the end wall by a rivet, which acts as a fulcrum forcing the proximal end of the tab downward to break open the scored panel portion. A plurality of spaced apart, unique indicia are disposed in an arc on the panel wall around the rivet. The distal lift end, after opening the can is lowered to lie against the end wall and is rotated to point to one of said indicia to thereby uniquely identify that opened container so that it will not be inadvertently used by another.

17 Claims, 1 Drawing Sheet

FIG. 1
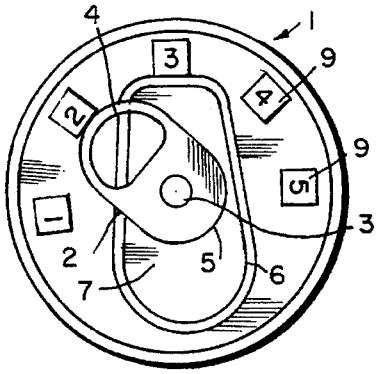
FIG. 2
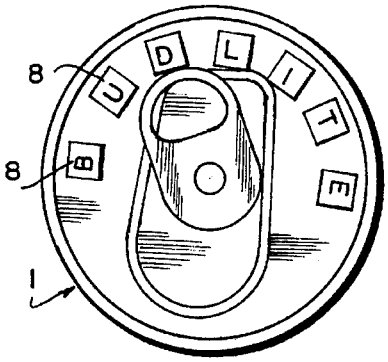
FIG. 5
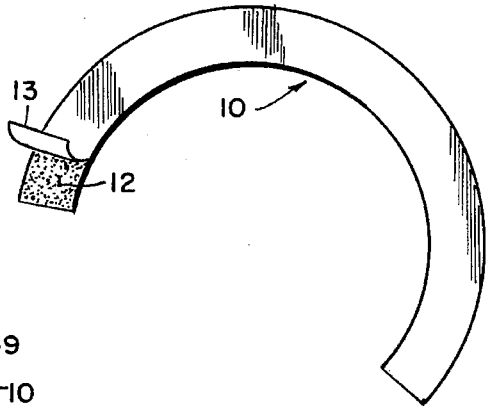
FIG. 3
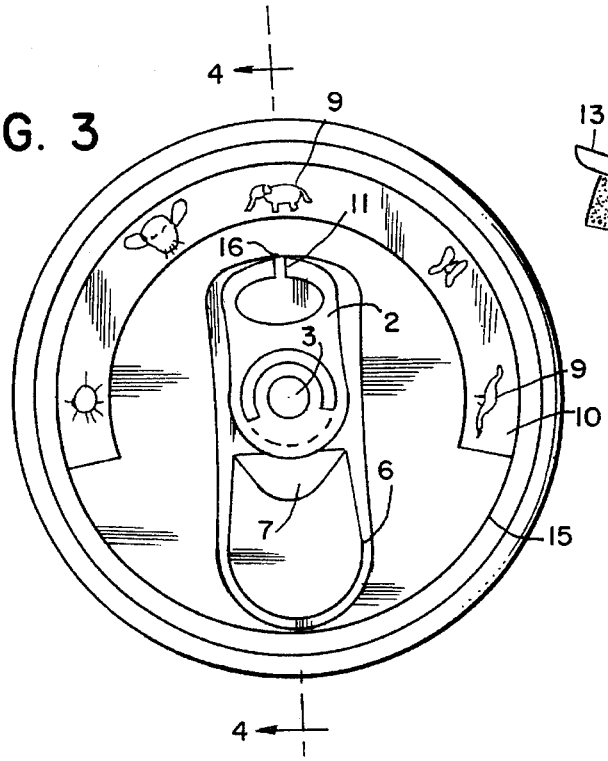
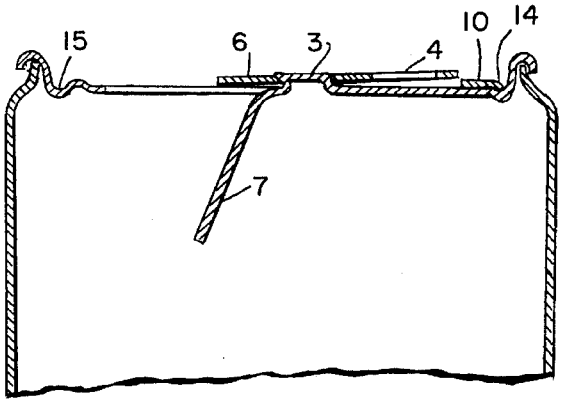
FIG. 4

INDICATING POP TOP BEVERAGE CONTAINER

BACKGROUND OF THE INVENTION

This invention relates to beverage containers of the pop top type having captive pull tabs and more particularly to means using the pull tab to identify a particular container to prevent cross contamination.

When a group is served beverages in pop top cans, and the members of the group are seated at a dining table, there is no problem with a member driving from another's can. However, when the members are moving about and setting the partially consumed cans down, such as at a party or in a fishing boat, they don't want to inadvertently pick up another's can and drink from it. It is disturbing to most and can lead to the spread of infectious disease. It is awkward to label each can separately. If they are cold, moisture coats the outside so that even if labels or markers are at hand, they cannot be easily applied.

Many beverage containers are now provided with a pull tab opener. The tab is secured to the top of the can by a rivet arrangement. When the tab is lifted at one end, the rivet acts as a fulcrum, forcing the other end down into a scored portion of the can top, breaking it free around the scored portion and bending it down into the can to provide access to the contents. The tab is then bent down flat so as to facilitate driving directly from the can. The tab in this condition is rotatable about the rivet, but is held tightly so that it will remain in the rotary position to which it is manually moved.

SUMMARY OF THE INVENTION

It is accordingly an object of the invention to provide a means for uniquely identifying a particular can that requires no special tools, conditions, skills or accessories. It is another object that the identifying means be available at negligible cost. It is yet another object that the identifying means provide an opportunity to display advertising or appealing indicia to the consumer.

The invention comprises an array of indicia applied in a semicircle on the beverage can top around the rivet means so that the tab may be selectively pointed at a particular indicium to uniquely identify that container. The tab will remain in that indicating position throughout use of that can. It requires deliberate manual rotation to move the tab from its selected position. Each indicium is unique and spaced apart.

These and other objects, advantages and features of the invention will become more apparent when the detailed description is studied in conjunction with the drawings.

BRIEF DESCRIPTION OF THE DRAWINGS

FIG. 1 is a top plan view of a container of the invention with embossed numbers.

FIG. 2 is a top plan view of another container of the invention with printed letters.

FIG. 3 is a top plan view of another container of the invention with images.

FIG. 4 is a section view taken through line 4—4 of FIG. 3.

FIG. 5 is a bottom plan view of the separately printed attachment of FIG. 3.

DETAILED DESCRIPTION OF THE PREFERRED EMBODIMENTS

In the drawings, like elements are indicated by the same reference numerals.

Referring now first to FIG. 1, a beverage can top 1 of the invention has a rigid pull tab 2 held in place, by a rivet type element 3 about which it may be rotated. When the distal end 4 of the tab is lifted upward the proximal end 5 is forced downward into the sealed can top by lever action, with the tab bending close to rivet element acting somewhat as a fulcrum. The sheet metal top 1 of the can is provided with a prescored arcuate line 6. As the proximal end 5 is forced downward onto the weakened portion 7 defined by the prescored line, it breaks free around the arc and bends down into the can, remaining hingedly attached where unscored. The tab is then bent down flat against the can top so as to not interfere with the pouring out of the beverage. The above description is exemplary of the many captive tab type pop top beverage cans well known in the art.

Combined with the conventional can is a plurality of distinctive indicia 9, in this case numbers, disposed in an arc centered on the rivet element 3. The indicia are so arranged that, after the can is opened, the tab 2 may be rotated to one of them, in this case the number 2, without the distal end 4 of the tab obscuring the opening formed at 7. For this reason, the indicia are limited to an arc of approximately 210°. Each number of the party is assigned a different indicium. When the can has been opened, the tab is pointed at the assigned indicia, and it will remain there until deliberately moved. An adult dispensing and opening the can may perform this task at a children's party. For young children, the indicia may be easily recognized images, such as cartoon characters, animals, symbols and the like. As shown in FIG. 2, the indicia 9 may convey a commercial message. The indicia may be embossed, etched, stamped, or imprinted on the can top by any of the means well known in the art.

As shown in FIGS. 3–5, the indicia 9 may be inscribed on a separate arcuate sheet 10 for application to the can top. As best seen in FIG. 5, the sheet 10 may be provided on the underside with adhesive 12 protected by a protective peel off layer 13 or it may peel off a larger web (not shown) as is well known in the art. The sheet 10 may have a down-turned rim 14 to fit into the perimetral groove 15 in can top, and may be springably stiff enough to hold in place without adhesive.

The rivet type element 3 is not a separate rivet but is formed by forcing the can top through a hole in the pull tab. The pull tab 2 may be provided with an embossed mark 11 or shaped into a point 16 to further define the center pointing to a particular indicia. Some tabs of self-opening beverage cans are already so made.

Since the basic structure of the can is not changed, the cost of introducing this distinct advantage to the public will be negligible. The benefits, both esthetically and in public health will be great. When advertising messages are so conveyed, the commercial advantages may also be considerable.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. In an easy open closure for a container, the closure of the type having a central panel with an integral rivet element, a displaceable panel portion in said central panel disposed outwardly of said rivet element, said panel portion defined by scoring, a captive lever tab with a distal lift end and a proximal end, said lever tab attached to said central panel by said rivet element between said ends, said lever tab being rotatable about said rivet element, whereby said proximal end breaks away said panel portion at said scoring and bends the panel portion inwardly along an unscored portion to provide an unobstructed opening and top when said distal lift end is lifted and then lowered to be adjacent said central panel, the improvement comprising:

a plurality of indicia, each one different from the others, disposed in an arc on said central panel, said arc substantially centered on said rivet element, said indicia being spaced apart from one another sufficiently so that said distal lift end of said lever tab may be rotated to point to a selected one of said indicia to thereby identify said container after said closure has been opened.

2. The closure according to claim 1, in which said indicia are alphanumeric.

3. The closure according to claim 1, in which said indicia are graphics.

4. The closure according to claim 1, in which said indicia are imprinted on said central panel.

5. The closure according to claim 1, in which said indicia are embossed on said central panel.

6. The closure according to claim 1, in which said indicia are engraved on said central panel.

7. The indicating closure according to claim 1, in which said indicia are disposed on a separate surface that is attached to said central panel by means for attaching said separate surface to said central panel.

8. The closure according to claim 7, in which said attaching means includes adhesive.

9. An easy open closure for a container that has a captive lever tab rotatably held on a central panel, wall by a rivet element, the lever tab having a proximal end for breaking open a scored panel portion to provide an opening and a distal lift end for lifting up to force the proximal end down for said breaking, the improvement comprising:

a plurality of spaced apart unique indicia disposed on said central panel wall in an arc, the arc substantially centered on said rivet element and extending through an angle of less than two hundred degrees so that after said closure has been opened, said distal lift end may be lowered and rotated to point to a selected one of said indicia to thereby uniquely identify said container without obstructing said opening.

10. The closure according to claim 9, in which said indicia are alphanumeric.

11. The closure according to claim 9, in which said indicia are graphics.

12. The closure according to claim 9, in which said indicia are imprinted on said central panel wall.

13. The closure according to claim 9, in which said indicia are embossed on said central panel wall.

14. The closure according to claim 9, in which said indicia are engraved on said central panel wall.

15. The indicating closure according to claim 9, in which said indicia are disposed on a separate surface that is attached to said central panel wall by means for attaching said separate surface to said central panel wall.

16. The closure according to claim 15, in which said attaching means includes adhesive.

17. In an easy open beverage container having a captive lever tab with a lifting end rotatably attached to an end wall by a rivet element for breaking open a scored panel portion to provide an opening, a method for identifying an opened container comprising the steps of:

(A) applying a plurality of unique spaced-apart indicia on said end wall in an arc of about two hundred degrees away from said opening, said arc substantially centered on said rivet element;

(B) lowering said tab substantially against said end wall after opening said container; and (C) rotating said tab about said rivet element so that said lifting end points at a unique one of said indicia to thereby uniquely identify said opened container.

* * * * *